US008438708B1

(12) United States Patent
Tuck

(10) Patent No.: US 8,438,708 B1
(45) Date of Patent: May 14, 2013

(54) SHOE LACE COVER

(76) Inventor: Keith Tuck, Montgomery, AL (US)

( * ) Notice: Subject to any disclaimer, the term of this patent is extended or adjusted under 35 U.S.C. 154(b) by 191 days.

(21) Appl. No.: 13/134,893

(22) Filed: Jun. 21, 2011

(51) Int. Cl.
*A43C 7/00* (2006.01)

(52) U.S. Cl.
USPC ..... 24/712.3; 36/1

(58) Field of Classification Search ..... None
See application file for complete search history.

(56) References Cited

U.S. PATENT DOCUMENTS

| | | | | |
|---|---|---|---|---|
| 2,871,537 | A | 2/1959 | Hickerson | |
| 3,473,198 | A | 10/1969 | Meier | |
| 3,940,873 | A * | 3/1976 | Lawless | 43/57.1 |
| 4,291,439 | A | 9/1981 | Riti | |
| 4,507,882 | A | 4/1985 | Harrell | |
| 4,571,854 | A | 2/1986 | Edens | |
| 4,780,936 | A | 11/1988 | Brecher | |
| 4,823,426 | A * | 4/1989 | Bragga | 15/210.1 |
| 4,879,787 | A | 11/1989 | Walls | |
| 4,949,437 | A | 8/1990 | Anderson | |
| 5,042,119 | A | 8/1991 | Williams | |
| 5,165,190 | A * | 11/1992 | Smyth | 36/50.1 |
| 5,170,573 | A * | 12/1992 | Clinch | 36/50.1 |
| 5,311,679 | A | 5/1994 | Birch, Sr. | |
| 5,671,517 | A | 9/1997 | Gourley | |
| 5,778,500 | A | 7/1998 | Illingworth | |
| 5,913,483 | A | 6/1999 | Polk | |
| 6,000,111 | A | 12/1999 | Deskins et al. | |
| 6,988,298 | B2 | 1/2006 | Ternasky et al. | |
| 7,404,242 | B1 | 7/2008 | Perler | |
| 7,640,640 | B1 | 1/2010 | Watkins | |
| 7,650,706 | B2 | 1/2010 | Wartel et al. | |
| 2004/0006856 | A1 | 1/2004 | Moreno | |
| 2005/0125972 | A1 | 6/2005 | Gibson | |
| 2008/0301918 | A1 | 12/2008 | Tal et al. | |
| 2009/0293240 | A1 | 12/2009 | Hubbard | |

* cited by examiner

*Primary Examiner* — Jack W. Lavinder
(74) *Attorney, Agent, or Firm* — Peter Loffler

(57) ABSTRACT

A shoe lace cover helps keep singled knotted laces tied and uses a pair of generally coextensive panels with one panel positioned in the tongue opening of a shoe between the tongue and laces and the other panel is positioned atop the laces, the panels removably secured to one another at their respective sides using cooperating hook and loop material. Each panel also has a tail that is secured to the other tail below the bottom of the laces and a strap is attached to the upper panel overwraps the knot of the laces and secures to the lower panel.

16 Claims, 4 Drawing Sheets

SHOE LACE COVER

BACKGROUND OF THE INVENTION

1. Field of the Invention

The present invention relates to a shoe lace cover that overlays tied shoe laces and helps keep the tied knot from becoming untied.

2. Background of the Prior Art

Shoe laces are the primary implement used to secure athletic shoes, such as running shoes, bike shoes, or even skates, onto a person's feet. Each shoe is donned, the laces are tied in a bow knot and the person is off to run, play a sport, skate, or simply walk. This method of securing shoes has been employed for decades and works quite well, although it is not without a particular drawback, that being that the knot can become untied, often at an inopportune time. Knot untying can result from many factors including a loose or otherwise poor initial knot tie or from movement over time during shoe wear, especially when the wearer is participating in a vigorous activity. In many instances, the solution is as simple as reknotting the laces and continuing on with the activity at hand. However, an untimely untied shoe can also present a sizable problem. If the shoe lace becomes untied during a vigorous activity such as playing basketball, running, or a myriad of other activities, an untied shoe creates the potential for injury for the wearer either from twisting of the ankle or knee from a shoe that is unexpectedly loose or that comes off of the foot completely, or from tripping over the loose shoe lace. In other instances retying the knot may prove challenging as in the case of small children who need others to tie their shoes or from persons who have physical limitations that either prevent such folks from being able to reach their shoes or that have insufficient strength or dexterity in their fingers and hands—from arthritis, for example—to be able to retie shoe laces.

To combat the problem of shoe lace knots becoming potentially untied, many people double knot the laces. Double knotted laces tend to hold the knot exceedingly well and rarely become untied. However, double knotting, even if there is sufficient length available in the laces to tie the double knot, has a substantial drawback. A properly tied single knot holds itself tied properly under most conditions, yet allows movement within the lace length so that the knot gives to some extent whenever the persons stresses their shoe or as a person's foot swells over time as the shoe is being worn, such swelling occurring at a more rapid rate with vigorous pursuits with the feet. This flexibility of the laces is necessary for proper foot flexing and expansion. On the other hand, a double knot holds exceptionally strong and allows almost no lace lengthening to occur even under strenuous conditions. This prevents the person's foot from flexing properly when needed and constricts the person's foot as the foot swells naturally as the length of shoe wearing marches on. Not only does this lack of lace flexibility increase the potential for injury, it also make the shoe become increasing uncomfortable to wear the longer the person wears the double knotted shoe.

To address these problems, lace protectors have been proposed. These devices interact with the shoe laces of a shoe and help maintain a single knotted shoe in a tied configuration even under prolonged use or under the high stresses imposed on the shoes and thus the laces. While many of these prior art devices work acceptably well, they are not without limitations. Many such devices are complex in design and construction so as to be relatively expensive to produce and sell as well as relatively difficult to use, often requiring a relatively long time to deploy or require undue dexterity to use which dexterity many people, even without physical limitations, may not have. Some devices require integration of the device onto the shoe via the laces so that the laces must be removed and reinstalled integral with the device. Although this installation can be a one-time event, such devices remain on the shoe indefinitely even when use of the device is not desired, as removal and reinstallment is time-consuming and cumbersome. This relative permanency of the device on the shoe discourages many users who only want to use such devices on a less than continuous basis.

What is needed is a device that can be applied to a shoe wherein the devices helps maintain the knot of single knotted laces wherein the device overcomes the above described shortcomings found in the art. Specifically, such a device must be of relatively simple design and construction and must be easy to install and deploy without the need to have acute dexterity in one's fingers. Such a device must be relatively quick and easy to install onto and remove from a pair of shoes so that use of the device is employed only when desired.

SUMMARY OF THE INVENTION

The shoe lace cover of the present invention addresses the aforementioned needs in the art by providing a device that is installed onto a typical pair of athletic shoes and helps hold the knot and prevent the knot from becoming untied in a single knotted shoe lace configuration. The shoe lace cover is of relatively simple design and construction, being produced using standard manufacturing techniques, so as to be relatively inexpensive to produce so as to be economically attractive to potential consumers of these types of devices. The shoe lace cover is quickly and easily installed onto a shoe and removed therefrom so that there is no need to have the present invention resident on the shoe when use of the device is not desired. Once the shoe lace cover is installed, making the device operational is quick and easy without the need to have special skills or unusually high finger dexterity.

The shoe lace cover of the present invention is comprised of a lower panel that has a first inner surface, a first outer surface, a first top and a first bottom joined by a pair of first sides. The lower panel also has a first tail that extends from the first bottom. A first portion of hook and loop material extends along each first side of the inner surface, is located on the first inner surface at the first tail, and is located on the outer surface below the first top. An upper panel has a second inner surface, a second outer surface, a second top and a second bottom joined by a pair of second sides. The upper panel also has a second tail extending from the second bottom. A strap is attached to the upper panel below the second top. A second portion of hook and loop material extends along each second side of the second inner surface, is located on the second inner surface at the second tail, and is located on the strap. The lower panel is positioned between the shoe laces and the tongue and the upper panel is positioned atop the shoe laces and is then secured to the lower panel via the corresponding hook and loop portions such that a knot and a pair of ears formed when the shoe laces are tied are secured and bounded within the upper panel and the lower panel. Securement of the upper panel with the lower panel is achieved by having the second portions of hook and loop material along each second side cooperatively mate with the first portions of hook and loop material along each first side, the second portion of hook and loop material on the second tail cooperatively mates with the first portion of hook and loop material on the first tail and the second portion of hook and loop material on the strap cooperatively mates with the first portion of hook and loop material on the first outer surface of the lower panel. Each of the first sides curves inwardly toward the first tail and each of the second sides curves inwardly toward the second tail. The lower panel and the upper panel are each made from a flexible material (leather, Nylon, etc.). The upper panel may be transparent or may have a message (advertisement, sports logo, etc.,) thereon. The strap and the upper panel may, but need not be monolithic.

BRIEF DESCRIPTION OF THE DRAWINGS

Similar reference numerals refer to similar parts throughout the several views of the drawings.

DESCRIPTION OF THE PREFERRED EMBODIMENT

Figure 1:
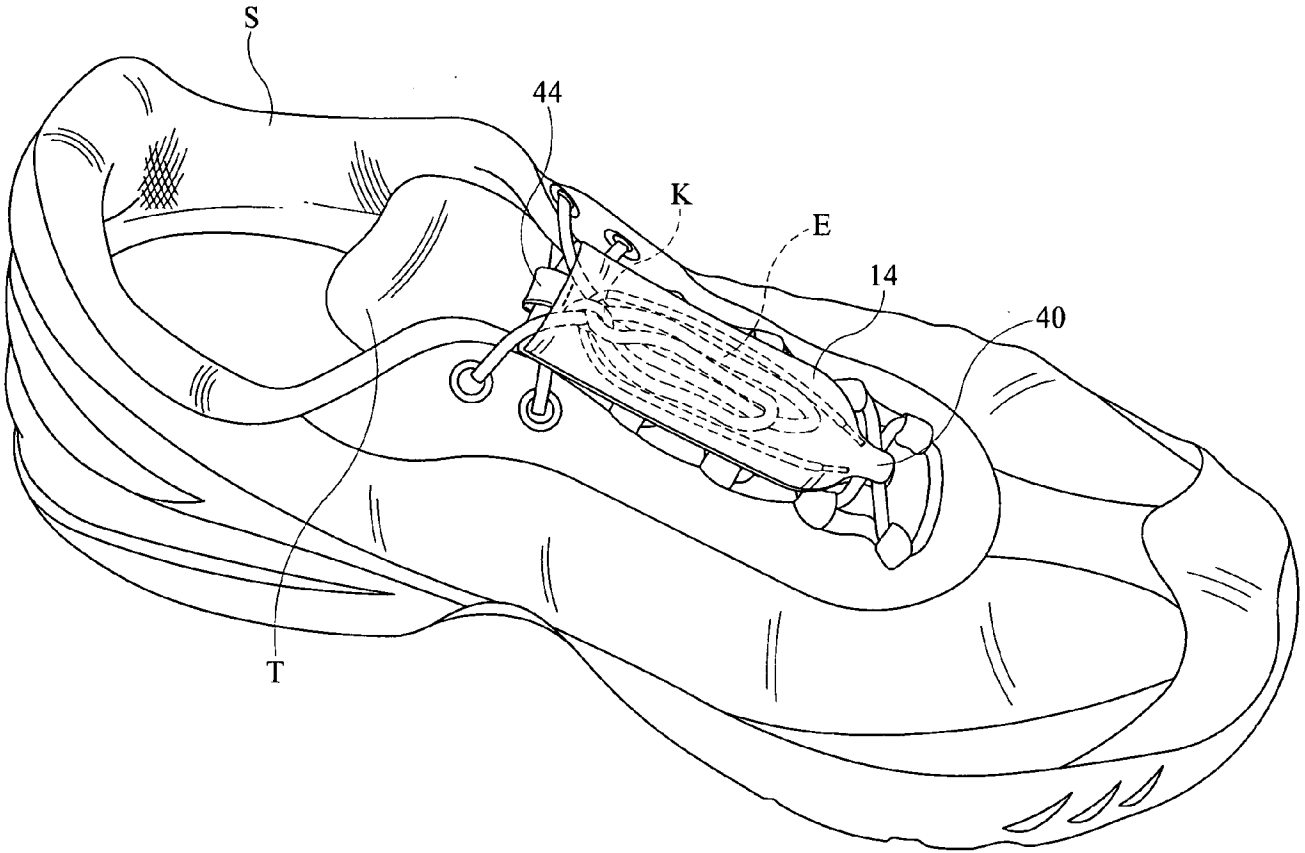
FIG. 1 is a perspective view of the shoe lace cover of the present invention installed on a shoe.
Figure 2:
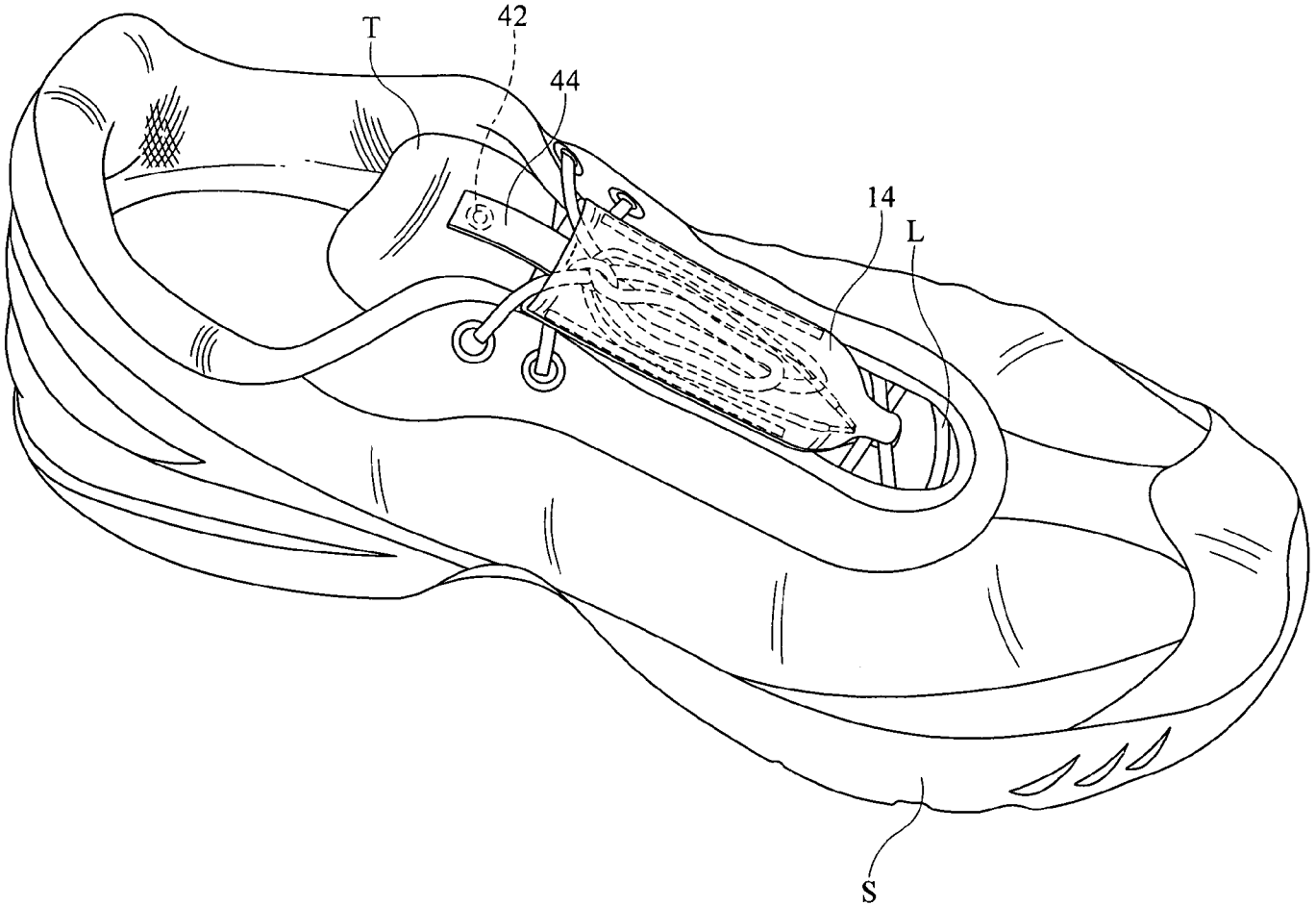
FIG. 2 is a perspective view of the shoe lace cover with the securement strap detached from the lower panel.
Figure 3:
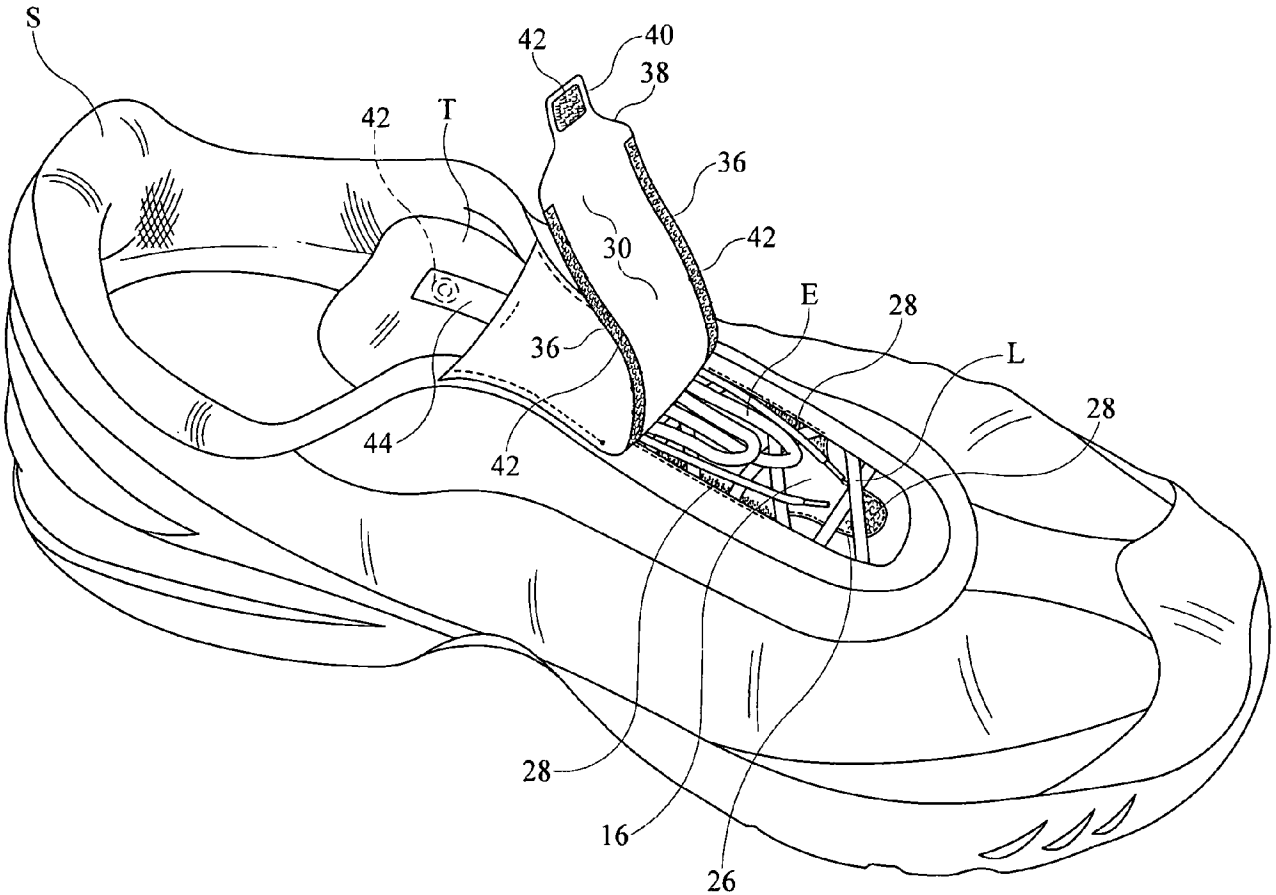
FIG. 3 is a perspective view of the shoe lace cover with the upper panel partially detached from the lower panel.
Figure 5:
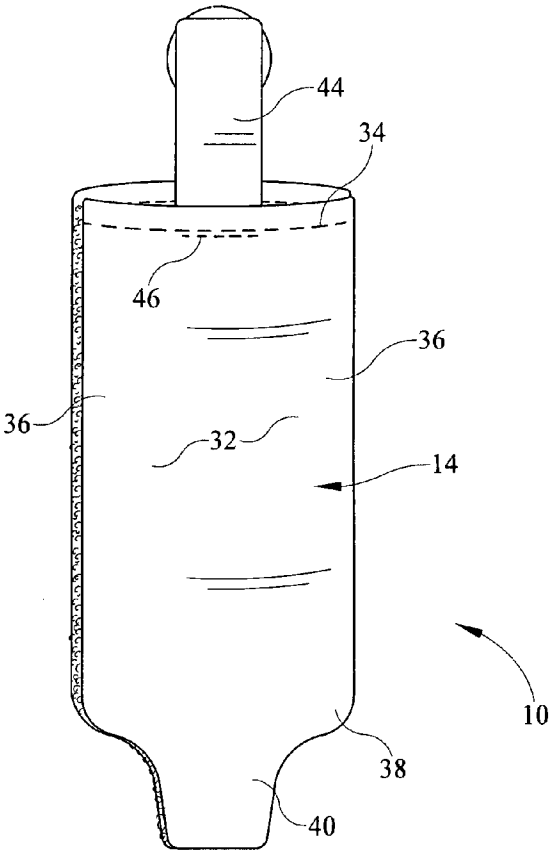
FIG. 5 is an upper perspective view of the shoe lace cover.
Figure 4:
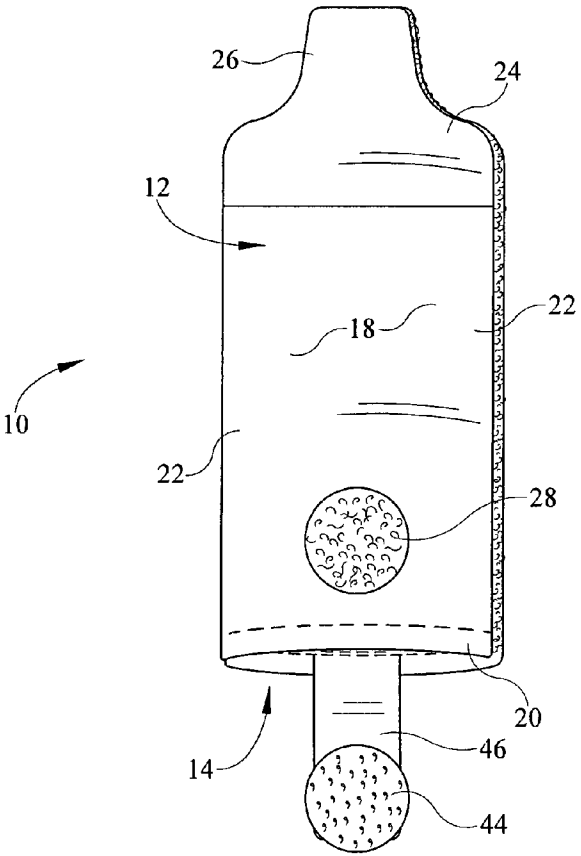
FIG. 4 is a lower perspective view of the shoe lace cover.

Referring now to the drawings, it is seen that the shoe lace cover of the present invention, generally denoted by reference numeral 10, is comprised of a lower panel 12 and an upper panel 14.

As seen, the lower panel 12 has an inner surface 16 and an outer surface 18 and has a top 20, a pair of sides 22 and a bottom 24 with a tail 26 extending from bottom 24 such that the two sides 22 each curve inwardly toward the tail 26. A portion 28 of cooperating hook and loop material (including the new hook and dart material) extends along each side 22 of the lower panel 12 on the inner surface 16 thereof and a portion 28 is also located on the inner surface 16 on the tail 26 and on the outer surface 18 of the lower panel 12 just below the top 20.

As also seen, the upper panel 14 is substantially similar in size and shape to the lower panel 14 and also has an inner surface 30 and an outer surface 32 and has a top 34, a pair of sides 36 and a bottom 38 with a tail 40 extending from bottom 40 such that the two sides 38 each curve inwardly toward the tail 40. A corresponding portion 42 of cooperating hook and loop material extends along each side 36 of the upper panel 14 on the inner surface 30 thereof and a portion 42 is also located on the inner surface 30 on the tail 40. A securement strap 44 is secured to the upper panel 14 just below the top 34 via any appropriate manner such as the illustrated stitching 46, adhesion etc., the securement strap 44 can be attached to either the inner surface 30 or the outer surface 32 of the upper panel 14. Alternately, the strap 44 can be monolithic with the upper panel 14. A corresponding portion 42 of hook and loop material is located on the distal end of the securement strap 44.

The lower panel 12 and the upper panel 14 are each made from an appropriate flexible and sturdy material such as leather, Nylon, cotton, etc., and may be similar to the upper U of the shoe S to which the device 10 is attached so that the device 10 looks like it is integral with the shoe S. The shoe lace cover 10 may also be colored so as to be color coordinated with the shoe S or may have an appropriate message (saying, sports team logo, etc.,) located on the outer surface 32 of the upper panel 14 or the upper panel may be transparent to allow the laces L to be seen.

In order to use the shoe lace cover 10 of the present invention, the lower panel 12 is positioned between the tongue T of the shoe S and the laces L with the inner surface 16 facing upwardly. The shoe laces L are tied as desired. The upper panel 14 is overlaid over the lower panel 12 so that the knot K and ears E of the tied shoe laces L are positioned between the sides 22 and 36 of the lower panel 12 and upper panel 14 respectively and the hook and loop portions 28 along the sides 22 of the lower panel 12 cooperatively mate with the corresponding hook and loop portions 42 along the sides 36 of the upper panel 14. Although the entire portions 28 and 42 of hook and loop material will not mate with one another due to the presence of the laces L, there is sufficient gapping, between the laces L, even in a tight lace L configuration, to assure a solid attachment of upper panel 14 with lower panel 12. The panels 12 and 14 are dimensioned so as to assure that their respective hook and loop portions 28 and 42 are within the tongue T opening of the shoe S. Additionally, the two tails 26 and 40 are mated to one another via their respective hook and loop portions 28 and 42 just below the bottom most length of shoe lace L or higher up the lace L configuration if an unusually long lace L configuration is present on the shoe S such as is the case with many ice skates and similar shoes S. Thereafter, the securement strap 44 is brought over top the knot K and is secured to the outer surface 18 of the lower panel 12 by cooperatively mating its portion 42 of hook and loop material with the portion 28 of hook and loop material located on the outer surface 18 of the lower panel 12. The knot K and the ears E of the laces L are now secured and bound within the device 10 making untying of the knot K unlikely.

If access to the knot K is desired, for example, if a tighter or looser knot K is desired, then the securement strap 44 is detached from the lower panel 12 and the upper section of the upper panel 14 is peeled away from the upper section of the lower panel 12. Once the knot K is adjusted as desired, the upper panel 14 is once again secured to the lower panel 12 and the securement strap 44 is again attached to the lower panel 12.

When use of the shoe lace cover 10 is no longer desired, then the securement strap 44 is detached from the lower panel 12, the upper panel 14 is detached from the lower panel 12, and the lower panel 12 is removed from the shoe S. This assures that the device 10 is quick and easy to install upon and remove from a typical shoe S.

While the invention has been particularly shown and described with reference to an embodiment thereof, it will be appreciated by those skilled in the art that various changes in form and detail may be made without departing from the spirit and scope of the invention.

I claim:

1. A shoe lace cover comprising:

a lower panel having a first inner surface, a first outer surface, a first top and a first bottom joined by a pair of first sides, and a first tail extending from the first bottom;

a first portion of hook and loop material extending along each first side of the inner surface, on the first inner surface at the first tail, and on the outer surface below the first top;

an upper panel having a second inner surface, a second outer surface, a second top and a second bottom joined by a pair of second sides, and a second tail extending from the second bottom;

a strap attached to the upper panel below the second top;

a second portion of hook and loop material extending along each second side of the second inner surface, on the second inner surface at the second tail, and on the strap; and wherein the upper panel is overlaid with the lower panel and the upper panel is removably secured to the lower panel by having the second portions of hook and loop material along each second side cooperatively mate with the first portions of hook and loop material along each first side, the second portion of hook and loop material on the second tail cooperatively mate with the first portion of hook and loop material on the first tail and the second portion of hook and loop material on the strap cooperatively mate with the first portion of hook and loop material on the first outer surface of the lower panel.

2. The shoe lace cover as in claim 1 wherein each of the first sides curves inwardly toward the first tail and each of the second sides curves inwardly toward the second tail.

3. The shoe lace cover as in claim 2 wherein the lower panel and the upper panel are each made from a flexible material.

4. The shoe lace cover as in claim 3 wherein the upper panel is transparent.

5. The shoe lace cover as in claim 4 wherein the strap and the upper panel are monolithic.

6. The shoe lace cover as in claim 1 wherein the lower panel and the upper panel are each made from a flexible material.

7. The shoe lace cover as in claim 1 wherein the upper panel is transparent.

8. The shoe lace cover as in claim 1 wherein the strap and the upper panel are monolithic.

9. The shoe lace cover as in claim 1 in combination with a shoe, the shoe having a tongue, an opening above the tongue, and a shoe laces spanning across the opening above the tongue such that the lower panel is positioned between the shoe laces and the tongue and the upper panel is positioned atop the shoe laces and is then secured to the lower panel such that a knot and a pair of ears formed when the shoe laces are tied are secured and bounded within the upper panel and the lower panel.

10. The shoe lace cover as in claim 9 wherein the lower panel and the upper panel are each made from a flexible material.

11. The shoe lace cover as in claim 9 wherein the upper panel is transparent.

12. The shoe lace cover as in claim 9 wherein the strap and the upper panel are monolithic.

13. The shoe lace cover as in claim 9 wherein each of the first sides curves inwardly toward the first tail and each of the second sides curves inwardly toward the second tail.

14. The shoe lace cover as in claim 13 wherein the lower panel and the upper panel are each made from a flexible material.

15. The shoe lace cover as in claim 14 wherein the upper panel is transparent.

16. The shoe lace cover as in claim 15 wherein the strap and the upper panel are monolithic.

* * * * *